United States Patent [19]

Barbieri et al.

[11] Patent Number: 4,555,315

[45] Date of Patent: Nov. 26, 1985

[54] HIGH SPEED COPPER ELECTROPLATING PROCESS AND BATH THEREFOR

[75] Inventors: Stephen C. Barbieri, Rutherford; Linda J. Mayer, Denville, both of N.J.

[73] Assignee: OMI International Corporation, Warren, Mich.

[21] Appl. No.: 614,088

[22] Filed: May 29, 1984

[51] Int. Cl.[4] ..... C25D 3/38

[52] U.S. Cl. ..... 204/52 R

[58] Field of Search ..... 204/52 R, 106

[56] References Cited

U.S. PATENT DOCUMENTS 3,770,598 11/1973 Creutz ..... 204/52 R 4,336,114 6/1982 Mayer et al. ..... 204/52 R

*Primary Examiner*—G. L. Kaplan

*Attorney, Agent, or Firm*—Richard P. Mueller

[57] ABSTRACT

An improved electrolyte composition and process for electrodepositing bright, level and ductile copper deposits on a substrate enabling use of conventional electroplating equipment for high-speed copper plating employing average cathode current densities substantially higher than heretofore feasible. The electrolyte contains an additive system comprising carefully controlled relative concentrations of:

(a) a bath soluble polyether compound;

(b) a bath soluble organic divalent sulfur compound;

(c) a bath soluble adduct of a tertiary alkyl amine with epichlorohydrin; and (d) a bath soluble reaction product of polyethyleneimine and an alkylating agent.

10 Claims, No Drawings

HIGH SPEED COPPER ELECTROPLATING PROCESS AND BATH THEREFOR

BACKGROUND OF THE INVENTION

The present invention broadly relates to an electrolyte composition and process for electrodepositing copper, and more particularly, to an electrolyte composition and process for the electrodeposition of copper from aqueous acidic copper plating baths, especially from copper sulfate and fluoroborate baths. More particularly, the present invention is directed to a novel additive system for producing bright, ductile, level copper deposits with good recess brightness on metal substrates, and particularly printed circuit boards, enabling usage of higher plating current densities in conventional electroplating equipment than heretofore possible.

A variety of aqueous acidic copper electroplating baths have heretofore been used or proposed for use incorporating various additive agents for electrodepositing bright, level and ductile copper deposits on various substrates. Typical of such prior art processes and electrolyte compositions are those described in U.S. Pat. Nos. 3,267,010; 3,328,273; 3,770,598; 4,110,176; 4,272,335 and 4,336,114 which, through mesne assignments, are assigned to the same assignee as the present invention.

While the electrolyte compositions and processes disclosed in the aforementioned United States patents provide for excellent bright, ductile and level copper deposits, problems are encountered when employing such electrolytes in conventional electrolplating apparatus when operating at relatively high cathode current densities, such as, for example, average current densities in excess of about 40 amperes per square foot (ASF) or higher. At such higher average cathode current densities to attain high speed plating of printed circuit boards, copper deposits are frequently obtained which are commercially unacceptable in accordance with the printed wiring board industry standards. It has been necessary, accordingly, to employ special electroplating equipment to enable the use of such higher average current densities in excess of about 40 ASF to achieve commercially acceptable deposits.

The present invention overcomes the problems associated with such prior art electrolyte compositions and processes by enabling high speed plating of copper at average current densities in excess of about 40 ASF in conventional equipment thereby achieving a high rate of electrodeposition of copper while at the same time attaining a copper deposit which meets the printed wiring circuit board industry standards.

SUMMARY OF THE INVENTION

The benefits and advantages of the present invention are achieved by an electrolyte composition and process for the electrodeposition of copper from an aqueous acidic electrolyte containing copper ions in an amount sufficient to electrodeposit copper on a substrate, hydrogen ions to provide an acidic pH, and a brightening and leveling amount of an additive system comprising controlled selective relative amounts of: (a) a bath soluble polyether compound; (b) a bath soluble organic divalent sulfur compound; (c) a bath soluble adduct of a tertiary alkyl amine with polyepichlorohydrin; and (d) a bath soluble reaction product of polyethyleneimine and an alkylating agent which will alkylate the nitrogen on the polyethyleneimine to produce a quaternary nitrogen and wherein said alkylating agent is selected from the group consisting of benzyl chloride, allyl bromide, propane sultone, dimethyl sulfate and wherein the reaction temperature ranges from about room temperature to about 120° C.

In accordance with the process aspects of the present invention, the aqueous acidic electroplating bath can be operated at temperatures ranging from about 16 up to about 38° C. and at average cathode current densities exceeding 40 ASF up to about 80 ASF employing conventional electroplating equipment such as a bath provided with air agitation.

Additional benefits and advantages of the present invention will become apparent upon a reading of the Description of the Preferred Embodiments taken in conjunction with the accompanying examples.

DESCRIPTION OF THE PREFERRED EMBODIMENTS

In accordance with the electrolyte composition and process aspects of the present invention, the aqueous acidic copper electrolyte may be either of the acidic copper sulfate or acidic copper fluoroborate types. In accordance with conventional practice, aqueous acidic copper sulfate baths typically contain from about 30 to about 100 grams per liter (g/l) of copper sulfate and about 180 to about 250 g/l of sulfuric acid. Acidic copper fluoroborate baths in accordance with prior art practice typically contain from about 150 to about 600 g/l fluoboric acid and up to about 60 g/l of copper fluoborate.

The aqueous acidic bath also desirably contains halide ions such as chloride and/or bromide anions, which are typically present in amounts not in excess of about 0.2 g/l.

The additive system of the present invention contains a controlled mixture of four essential constituents of which the first constituent (a) comprises a bath soluble polyether compound, preferably, polyethers containing at least six ether oxygen atoms and having a molecular weight of from about 150 to about 1 million. Of the various polyether compounds which may be used, excellent results have been obtained with polypropylene, polyethylene and glycols including mixtures of these, of average molecular weight of from about 600 to 4,000, and alkoxylated aromatic alcohols having a molecular weight of about 300 to 2500. Exemplary of the various preferred polyether compounds which may be used are those as set forth in Table I of U.S. Pat. No. 4,376,114. Typically, such polyether compounds include polyethylene glycols (average M.W. of 400–1,000,000); ethoxylated naphthols (Containing 5–45 mols ethylene oxide groups); propoxylated naphthols (containing 5–25 mols of propylene oxide groups); ethoxylated nonyl phenol (containing 5–30 mols of ethylene oxide groups); polypropylene glycols (average M.W. of 350–1,000); block polymers of polyethylene and polyoxypropylene glycols (average M.W. of 350–250,000); ethoxylated phenols (containing 5–100 mols of ethylene oxide groups); propoxylated phenols (containing 5–25 mols of propylene oxide groups); or the like. Desirably, the plating baths of the present invention contain these polyether compounds in amounts within a range of about 0.6 to about 26 micromols per liter, with the lower concentrations generally being used with the higher molecular weight polyethers. Typically, the polyether compounds are employed in a range of about 3 to about 13 micromols/l.

The second essential constituent (b) of the additive system of the present invention comprises organic divalent sulfur compounds including sulfonated or phosphonated organic sulfides, i.e., organic sulfide compounds carrying at least one sulfonic or phosphonic group. These organic sulfide compounds containing sulfonic or phosphonic groups may also contain various substituting groups, such as methyl, chloro, bromo, methoxy, ethoxy, carboxy or hydroxy, on the molecules, especially on the aromatic and heterocyclic sulfide-sulfonic or phosphonic acids. These organic sulfide compounds may be used as the free acids, the alkali metal salts, organic amine salts, or the like. Exemplary of specific sulfonate organic sulfides which may be used are those set forth in Table I of U.S. Pat. No. 3,267,010, and Table III of U.S. Pat. No. 4,181,582, as well as the phosphonic acid derivatives of these. Other suitable organic divalent sulfur compounds which may be used include $HO_3P—(CH_2)_3—S—S—(CH_2)_3—PO_3H$, as well as mercaptans, thiocarbamates, thiolcarbamates, thioxanthates, and thiocarbonates which contain at least one sulfonic or phosphonic group.

A particularly preferred group of organic divalent sulfur compounds are the organic polysulfide compounds. Such polysulfide compounds may have the formula $XR_1—(S)_nR_2SO_3H$ or $XR_1—(S)_nR_2PO_3H$ wherein $R_1$ and $R_2$ are the same or different alkylene group containing from about 1 to 6 carbon atoms, X is hydrogen, $SO_3H$ or $PO_3H$ and n is a number from about 2 to 5. These organic divalent sulfur compounds are aliphatic polysulfides wherein at least two divalent sulfur atoms are vicinal and wherein the molecule has one or two terminal sulfonic or phosphonic acid groups. The alkylene portion of the molecule may be substituted with groups such as methyl, ethyl, chloro, bromo, ethoxy, hydroxy, and the like. These compounds may be added as the free acids or as the alkali metal or amine salts. Exemplary of specific organic polysulfide compounds which may be used are set forth in Table I of column 2 of U.S. Pat. No. 3,328,273 and the phosphonic acid derivatives of these.

Desirably, these organic sulfide compounds are present in the plating baths of the present invention in amounts within the range of about 11 to about 441 micromols per liter, preferably, about 56 to about 220 micromols/l.

Constituent (c) of the additive system comprises a bath soluble adduct of a tertiary alkyl amine with polyepichlorohydrin corresponding to the general structural formula:

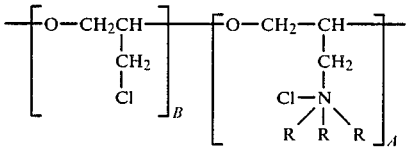

wherein:

R is the same or different and is methyl or ethyl,

A and B are integers whose sum is an integer of from 4 to about 500, and

A:B is at least about 1:5.

The polyquaternary amines of the foregoing structural formula may have molecular weights ranging from about 600 to about 100,000 and are selected so as to be soluble in the aqueous acidic electrolyte. Such quaternary adducts of polyepichlorohydrin with tertiary alkyl amines can conveniently be prepared by contacting a polyepichlorohydrin with a solution of a tertiary alkyl amine in a suitable solvent at temperatures of from about 50° C. to about 120° C., preferably at a temperature of about 100° C. Solvents suitable are water and alcohol and the reaction is preferably performed in the presence of vigorous agitation for a period of from about 2 to about 8 hours or more. When amines such as trimethylamine, for example, are employed which are of relatively high volatility, the reaction is carried out in a closed vessel such as an autoclave under pressure. On the other hand, amines of higher boiling point, such as triethylamine, for example, the reaction can be carried out at atmospheric pressure under reflux. In either event, the quaternary adduct product can be separated from the reaction mixture by distilling off the solvent and any unreacted amine.

The preparation and characteristics of such quaternary adducts and the characteristics thereof is more fully described in U.S. Pat. No. 3,320,317 granted May 16, 1967 to which reference is made for further details of such products useable in accordance with the present brightening and leveling system.

The quaternary adduct is employed in the aqueous acid copper electrolyte in amounts ranging from as low as about 0.3 up to concentrations as high as about 15 micromols per liter, with amounts ranging from about 2 to about 7 micromols/l being preferred for most electronic circuit board plating operations.

The fourth essential constituent of the additive system comprising part (d) is a bath soluble reaction product of polyethyleneimine and an alkylating agent which will alkylate the nitrogen on the polyethyleneimine to produce a quaternary nitrogen. The alkylating agent is selected from the group consisting of benzyl chloride, allyl bromide, propane sultone, dimethyl sulfate or the like. The reaction temperature to produce the product conventionally ranges from about room temperature to about 120° C. A particularly satisfactory reaction product for use in the brightening and leveling system comprises the product of polyethyleneimine with benzyl chloride. The reaction product (d) can be employed in amounts ranging from about 0.0024 to about 7 micromols per liter, with amounts of from about 1 to about 4 micromols/l being particularly preferred for the electroplating of electronic circuit boards.

The reaction product, method of synthesis, and suitable alkylating groups are more fully described in U.S. Pat. No. 3,770,598 the substance of which is incorporated herein by reference and to which further reference is made for additional details of satisfactory reaction products for use in accordance with the present invention.

In order to achieve the unexpected benefits in the practice of the present invention, it is also important that the four essential constituents (a), (b), (c) and (d) as hereinbefore defined, be present in the additive system in controlled relative ratios within the concentrations set forth. It has been established that the mol ratio of ingredient (c) to (d) [(c):(d)] can range from about 9:1 to about 1:10 with a mol ratio of about 2:1 to about 1:1 being particularly preferred. Additionally, it has been established that the sum of the mols of (a) and (b) should be present at a mol ratio relative to the sum of the mols of (c) and (d) [(a)+(b):(c)+(d)] within a range of about 35:1 to about 2:1 with a mol ratio of about 21:1 to about 14:1 being particularly preferred.

In accordance with the process aspects of the present invention, the acidic copper plating bath is typically operated at average cathode current densities in excess of about 40 ASF up to as high as about 80 ASF employing conventional plating equipment. Conventional plating equipment as herein employed is defined as equipment in which solution agitation relative to the substrate being plated is achieved primarily through the use of conventional air agitation. While some supplementary agitation may be provided through recirculation of the electrolyte by pumps through filters for providing clarification of the electrolyte, such supplemental agitation is minimal. Accordingly, such conventional equipment is intended to distinguish from special high speed plating equipment employing plating cells whereby the electrolyte is rapidly passed through in contact with the surface of the substrate achieving a high degree of agitation through turbulent flow of the electrolyte. Such specialized high-speed equipment, while satisfactory for electrodepositing copper at high cathode current densities, is relatively expensive and not universally adaptable for plating a variety of different substrates of different sizes and shapes. The present invention enables the use of conventional air or mechanically agitated baths to be employed which are universally adaptable to such work pieces at average cathode current densities substantially above those heretofore employed in accordance with prior art electrolytes while still attaining copper deposits commercially acceptable and in compliance with printed circuit board industry standards.

The electrolyte during the electrodeposition process may range from about 16° C. up to about 38° C. with temperatures ranging from about 21° C. to about 27° C. being typical and preferred.

In order to further illustrate the improved aqueous acidic copper electrolyte composition and process of the present invention, the following examples are provided. It will be understood that the examples are provided for illustrative purposes and are not intended to be limiting of the scope of the present invention as herein described and as set forth in the subjoined claims.

EXAMPLE 1

An electrolyte prepared in accordance with a preferred practice of the present invention particularly applicable for copper plating electronic circuit boards is as follows:

| INGREDIENT | CONCENTRATION |
|---|---|
| Copper Ions | 21 g/l |
| Sulfuric acid | 210 g/l |
| Chloride ions | 88 mg/l |
| Additive System | |
| (a) Polyethylene glycol (M. Wt. 3350) | 22 mg/l (6.6 mm/l)* |
| (b) Sulfoalkylsulfide (M. Wt. 354) | 39 mg/l (110.2 mm/l) |
| (c) Quaternary epichlorohydrin (M. Wt. 2000-5000) | 13 mg/l (3.7 mm/l) |
| (d) Polybenzylethyleneimine (M. Wt. 835) | 1.5 mg/l (1.8 mm/l) |

*micromols per liter

Ingredient (b) in the additive system comprised the disodium salt of propane disulfide while ingredient (c) comprised the quaternary ammonium salt of polyepichlorohydrin.

The foregoing electrolyte is controlled at a temperature of 75° F. and the bath is provided with moderate air agitation. A two-inch by two-inch test circuit board (0.02 square feet) is plated at 1.2 amperes (60 ASF) for a period of 30 minutes. A bright copper deposit is produced which is level over the substrate and the imperfections in the apertures through the circuit board. The copper deposit is also observed to possess sufficient ductility to pass the thermal shock test (MIL-55110C). The foregoing electrodeposit was obtained by maintaining an anode area of 0.06 square feet providing an anode-to-cathode area ratio of about 3:1.

While it will be apparent that the preferred embodiments of the invention disclosed are well calculated to fulfill the objects above stated, it will be appreciated that the invention is susceptible to modification, variation and change without departing from the proper scope of fair meaning of the subjoined claims.

What is claimed is:

1. In an aqueous acidic electrolyte containing copper in an amount sufficient to electrodeposit copper on a substrate, the improvement comprising incorporating in the electrolyte a brightening and leveling amount of an additive system comprising a mixture of:

(a) a bath soluble polether compound, (b) a bath soluble organic divalent sulfur compound, (c) a bath soluble adduct of a tertiary alkyl amine with polyepichlorohydrin corresponding to the structural formula:

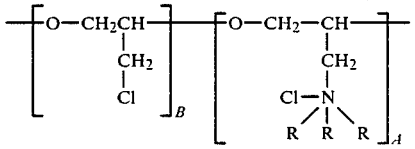

wherein:

R is the same or different and is methyl or ethyl,

A and B are integers whose sum is an integer of from 4 to about 500, and

A:B is at least about 1:5 and (d) a bath soluble reaction product of polyethyleneimine and an alkylating agent which will alkylate the nitrogen on the polyethyleneimine to produce a quaternary nitrogen and wherein said alkylating agent is selected from the group consisting of benzyl chloride, allyl bromide, propane sultone, dimethyl sulfate and wherein the reaction temperature ranges from about room temperature to about 120° C., said additive system present to provide a mol ratio of (c):(d) within a range of about 9:1 to about 1:10 and a mol ratio of (a)+(b):(c)+(d) within a range of about 35:1 to about 2:1, and being substantially free of compounds containing substituted phthalocyanine radicals.

2. The electrolyte as defined in claim 1 in which said mol ratio of (c):(d) is about 2:1 to about 1:1.

3. The electrolyte as defined in claim 1 in which said mol ratio of (a)+(b):(c)+(d) is about 21:1 to about 14:1.

4. The electrolyte as defined in claim 1 in which (a) is present in an amount of about 0.6 to about 26 micromols/l, (b) is present in an amount of about 11 to about 441 micromols/l, (c) is present in an amount of about 0.3 to about 15 micromols/l, and (d) is present in an amount of about 0.0024 to about 7 micromols/l.

5. The electrolyte as defined in claim 1 in which (a) is present in an amount of about 3 to about 13 micromols/l, (b) is present in an amount of about 56 to about 220 micromols/l, (c) is present in an amount of about 2 to about 7 micromols/l, and (d) is present in an amount of about 1 to about 4 micromols/l.

6. The electrolyte as defined in claim 1 in which said mol ratio of (c):(d) is about 2:1 to about 1:1 and said mol ratio of (a)+(b):(c)+(d) is about 21:1 to about 14:1.

7. The electrolyte as defined in claim 6 in which (a) is present in an amount of about 3 to about 13 micromols/l, (b) is present in an amount of about 56 to about 220 micromols/l, (c) is present in an amount of about 2 to about 7 micromols/l, and (d) is present in an amount of about 1 to about 4 micromols/l.

8. A process of electrodepositing a copper plating on a substrate which comprises the step of electrodepositing copper from an aqueous acidic electrolyte of a composition as defined in claim 1.

9. A process as defined in claim 8 including the further step of controlling the temperature of said electrolyte within a range of about 16° to about 38° C.

10. A process as defined in claim 8 including the further step of controlling the average cathode current density during the electrodepositing step within a range of about 40 to about 80 ASF.

* * * * *